US006369500B1

(12) United States Patent
Joung

(10) Patent No.: US 6,369,500 B1
(45) Date of Patent: Apr. 9, 2002

(54) SHIELD FROM EARTH MAGNETIC FIELD, FOR NECK OF CATHODE RAY TUBE

(75) Inventor: Jang-Jin Joung, Kyonggi-do (KR)

(73) Assignee: Samsung SDI Co., Ltd., Youngin, Kyung-do (KR)

( * ) Notice: Subject to any disclaimer, the term of this patent is extended or adjusted under 35 U.S.C. 154(b) by 0 days.

(21) Appl. No.: 09/260,776

(22) Filed: Mar. 2, 1999

(30) Foreign Application Priority Data

Jun. 11, 1998 (KR) ..... 98-21652

(51) Int. Cl.[7] ..... H01J 29/88
(52) U.S. Cl. ..... 313/479; 313/402; 335/211
(58) Field of Search ..... 313/313, 479, 313/402, 440, 441; 315/8, 85; 348/820, 825; 174/35 MS; 335/210, 211

(56) References Cited

U.S. PATENT DOCUMENTS 3,240,985 A * 3/1966 Ammerman et al. ..... 315/8
3,576,395 A * 4/1971 Arrington et al. ..... 348/825
4,019,085 A * 4/1977 Sakata ..... 313/402
4,189,618 A * 2/1980 Bretts et al. ..... 174/35 MS
4,392,083 A * 7/1983 Costello ..... 315/85
4,598,165 A * 7/1986 Tsai ..... 174/36
4,600,858 A * 7/1986 Iwasaki et al. ..... 313/413
4,728,915 A * 3/1988 Konosu et al. ..... 335/211
4,962,333 A * 10/1990 Sluyterman ..... 313/440
5,207,841 A * 5/1993 Shigeta et al. ..... 148/307
5,229,689 A * 7/1993 Forsblad et al. ..... 315/85
5,325,018 A * 6/1994 El-Hamamsy ..... 315/85
5,411,813 A 5/1995 Zeltser
5,473,492 A 12/1995 Terunuma et al.
5,478,416 A 12/1995 Takaoka et al.
5,994,704 A * 11/1999 Nakasuji ..... 250/396 ML

* cited by examiner

*Primary Examiner*—Nimeshkumar D. Patel
*Assistant Examiner*—Karabi Guharay
(74) *Attorney, Agent, or Firm*—Robert E. Bushnell, Esq

(57) ABSTRACT

A device for shielding the earth magnetic field permeating through a neck of a cathode ray tube (CRT) to improve purity, raster and convergence characteristics in the CRT. The device for shielding the earth magnetic field according to the present invention includes a tube type shielding device, the device made of a material having a high magnetic permeability and low coercive force, and the device having four evenly spaced extension parts formed on the periphery thereof along the CRT axis. The device is made of a Ni—Fe permalloy including Ni of more than 50 weight %, preferably about 78.5 weight %. The device has an inner diameter capable of mounting on the outer surface of the neck. Alternatively, the device may be mounted on the neck by means of a both-sided adhesive tape. The device may be also securely mounted on the neck by means of a thermal contraction tube.

20 Claims, 6 Drawing Sheets

SHIELD FROM EARTH MAGNETIC FIELD, FOR NECK OF CATHODE RAY TUBE

BACKGROUND OF THE INVENTION

1. Field of the Invention

This invention relates to a shield of an earth magnetic field which affects convergence characteristic in a cathode ray tube (CRT), and more particularly to a device for shielding an earth magnetic field which passes through a neck of the CRT and affects an electron gun to prevent the convergence of electron beams.

2. Description of the Prior Art

Typically, a cathode ray tube (CRT) includes a face panel, a funnel and a neck. Electron beams of red (R), green (G) and blue (B) emitted from an electron gun mounted on the neck are deflected by a deflection yoke provided on the periphery of the funnel and are landed on the corresponding R, G, and B phosphor screen to produce a desired picture. In this case, the CRT is affected by an earth magnetic field to change the traces of the electron beams, so that a raster position is changed and purity and convergence characteristics are deteriorated. Accordingly, an inner shield is provided in the funnel of the CRT to shield the earth magnetic field.

When the inner shield is positioned in the magnetic field, magnetic dipoles in the inner shield are orderly arranged by its spin moment and the inner shield becomes magnetized. The magnetic force generated from the magnetized inner shield counterbalances or interferes the earth magnetic field, whereby the affection on the electron beams in the CRT by the earth magnetic field is merely decreased by 50%.

Shielding effect of the inner shield in the CRT depends on its component. Generally, the component of high magnetic permeability and low coercive force has good shielding ability.

However, the inner shield of any good component cannot decrease the affection of the earth magnetic field in the CRT more than 50%.

SUMMARY OF THE INVENTION

Accordingly, the present invention is directed to a device for shielding an earth magnetic field that substantially obviates the problems due to limitations and disadvantages of the related art.

It is an object of the invention to provide a device for shielding the earth magnetic field permeating through a neck of a cathode ray tube (CRT) to improve purity, raster and convergence characteristics in the CRT.

The device for shielding the earth magnetic field according to the present invention includes a tube type shielding device, the device made of a material having a high magnetic permeability and low coercive force, and the device having four evenly spaced extension parts formed on the periphery thereof along the CRT axis.

The device may be made of a Ni—Fe permalloy comprising Ni (nickel) more than 50 weight %, preferably 78.5 weight %. The Ni—Fe alloy has a good magnetic force permeability and good working characteristics, such as wear resistance, ductility and malleability.

The device has an inner diameter to be mounted on the outer surface of the neck. Alternatively, the device may be mounted on the neck by means of a both-sided adhesive tape. The device may be also mounted on the neck by using a thermal contraction tube. The thermal contraction tube is contracted by heating after applying the thermal contraction tube on an outer surface of the device and neck.

A permanent magnet may be provided on the device to set up a magnetic field. Preferably, the magnetic force of the permanent magnet is between 1 mG (gauss) and 10 G. The permanent magnet may be the type of a ferrite or a rubber magnet and provides a magnetic field to decrease the affection by the earth magnetic field on the neck of the CRT.

BRIEF DESCRIPTION OF THE DRAWINGS

The present invention will become more fully understood from the detailed description given hereinafter and the accompanying drawings which are given by way of illustration only, and thus are not limited of the present invention and wherein.

DETAILED DESCRIPTION OF THE PREFERRED EMBODIMENTS

Figure 1:
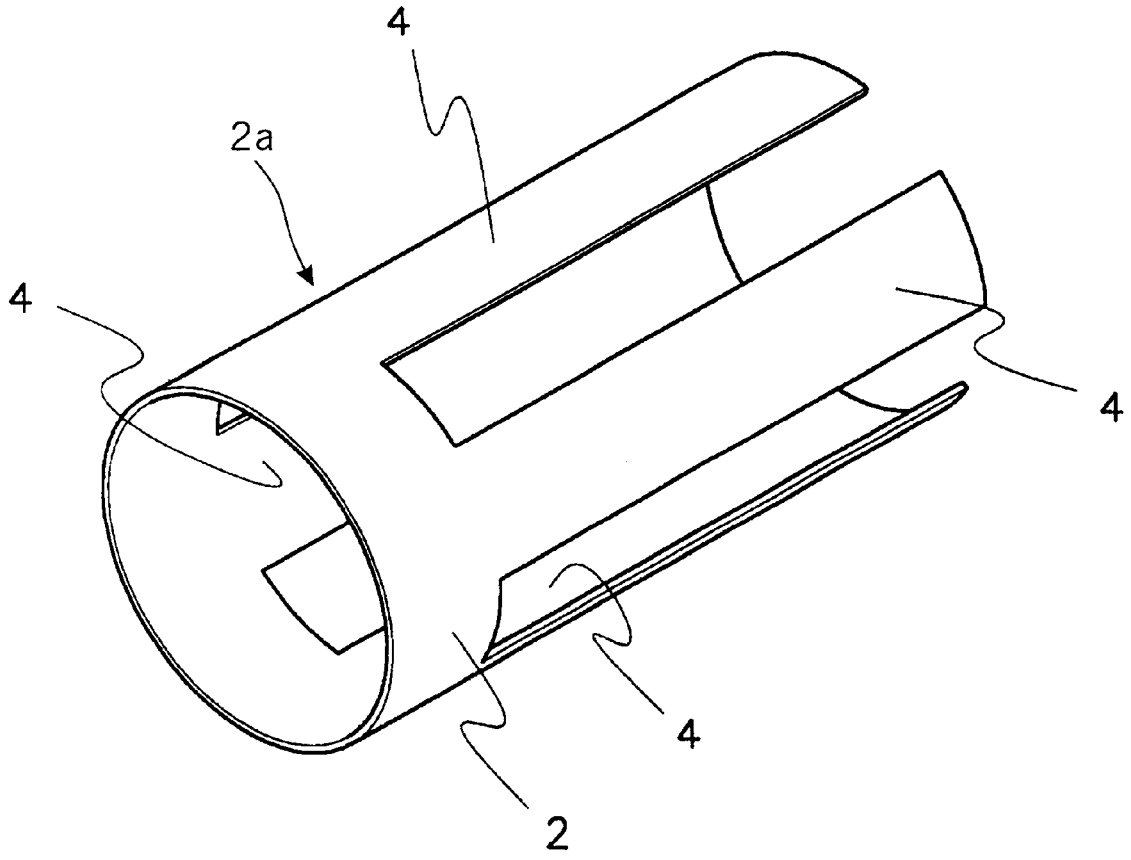
FIG. 1 is a perspective view showing a device for shielding an earth magnetic field according to the present invention.

The following is the description of the preferred embodiments according to the present invention. In the drawings, like reference numerals have been used to identify like elements in each figure.

Referring to FIG. 1, the device for shielding the earth magnetic field according to the present invention includes a tube type shielding device 2, the device 2 is made of a material having a high magnetic permeability and low coercive force, and the device 2 includes a shielding member 2*a* and four evenly spaced extension parts 4 formed on the periphery of the shielding member 2*a* along a cathode ray tube axis.

The device 2 may be made of a Ni—Fe permalloy comprising Ni (nickel) more than 50 weight %, preferably 78.5 weight %. The Ni—Fe alloy has a good magnetic force permeability and good working characteristics, such as wear resistance, ductility and malleability.

According to the present invention, four slots are necessarily formed between four extension parts 4 of the device 2 to decrease an affection on electron beams in the CRT.

Figure 2:
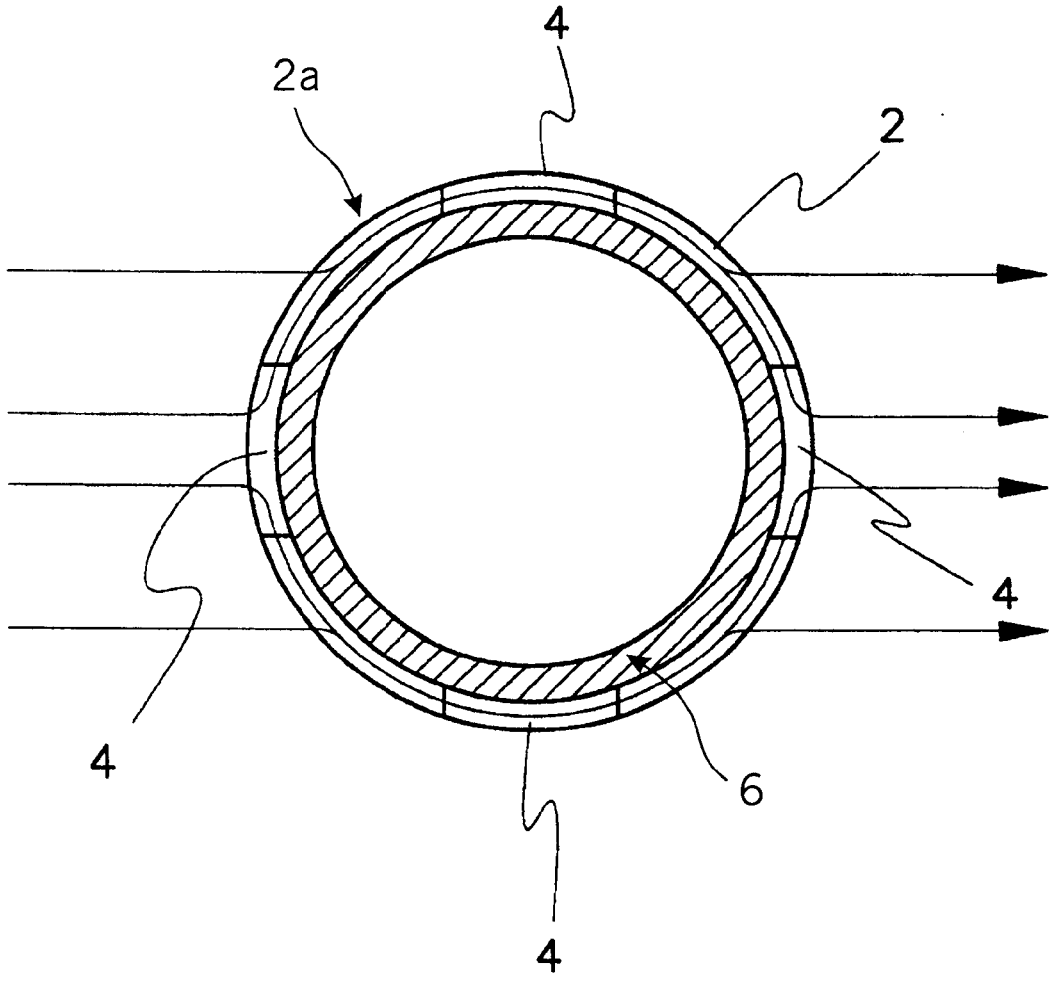
FIG. 2 is a sectional view showing a neck of a CRT in which the device according to the present invention is employed.
Figure 3:
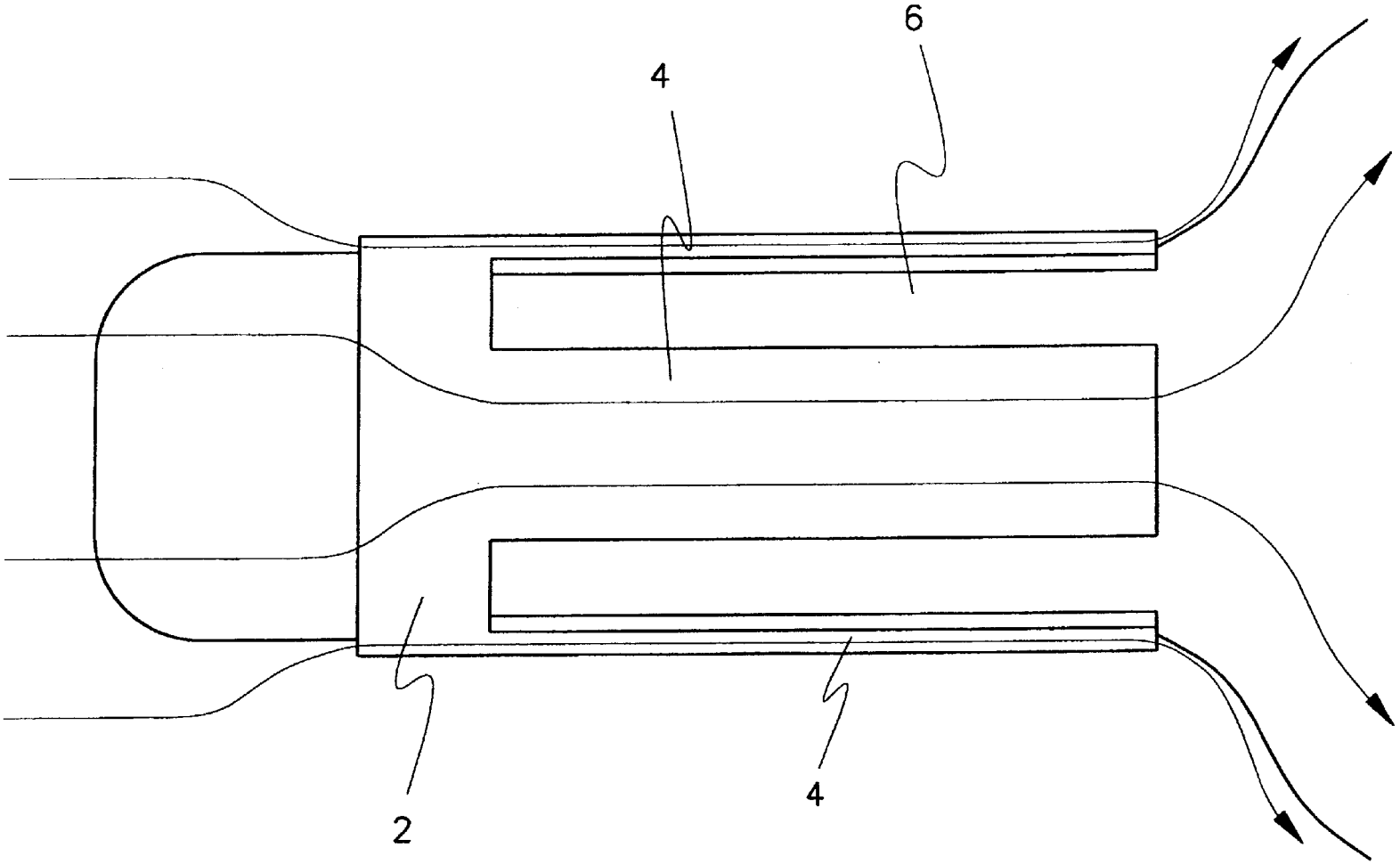
FIG. 3 is a schematic view showing a change of the earth magnetic field incident on the front of the neck in FIG. 2.

The device 2, including the shielding member 2*a*, has an inner diameter corresponding to an outer diameter of a neck 6 and is provided adjacent to the outer surface of the neck 6. The respective four extension parts 4 are equally spaced with respect to each other and are positioned along and at the top and bottom surfaces of the neck 6, and the left and right surfaces thereof, respectively. (As shown in FIGS. 1–3)

The extension parts 4 positioned on the left and right surfaces of the neck 6 change horizontal traces of the electron beams. The extension parts 4 positioned on the top and bottom surfaces change longitudinal traces of the electron beams. Therefore, the electron beams emitted from an electron gun are not affected by the earth magnetic field. (as shown in FIG. 3).

The changes of the convergence of the electron beams in the CRT according to the present invention compared with those of the prior CRT are provided as follows.

The earth magnetic field is set on the pre-selected positions:

on the east position, to the east-west direction −300 mG; and to the north-south direction 0 mG;

on the west position, to the east-west direction +300 mG; and and to the north-south direction 0 mG;

on the south position, to the east-west direction 0 mG; and to the north-south direction +300 mG; and on the north position, to the east-west direction 0 mG; and to the north-south direction −300 mG.

A convergence cross in the east direction to the west direction of the red and blue pattern distribution is:

In the Prior CRT

| | | | | |
|---|---|---|---|---|
| −0.12 | −0.08 | −0.07 | −0.05 | −0.16 |
| −0.13 | −0.1 | 0.01 | 0.09 | 0.12 |
| −0.02 | −0.02 | −0.01 | −0.01 | 0.02 |
| −0.15 | −0.12 | −0.02 | 0.08 | 0.15 |
| 0.06 | 0.04 | 0.04 | 0.05 | 0.09 |
| −0.22 | −0.13 | −0.1 | 0.11 | 0.16 |

In the Present Invention

| | | | | |
|---|---|---|---|---|
| −0.05 | −0.02 | −0.02 | 0 | −0.05 |
| −0.02 | −0.02 | 0 | 0 | 0.02 |
| −0.02 | −0.02 | −0.01 | −0.01 | 0.02 |
| −0.03 | −0.01 | −0.02 | 0.02 | 0.03 |
| 0.03 | 0.02 | 0.04 | 0.05 | 0.05 |
| −0.05 | −0.03 | −0.01 | 0.02 | 0.04 |

The convergence cross in the east direction to the south direction of the red and blue pattern distribution is:

In the Prior CRT

| | | | | |
|---|---|---|---|---|
| −0.08 | −0.04 | −0.03 | −0.01 | −0.09 |
| −0.19 | −0.18 | 0.13 | 0.14 | −0.11 |
| 0.01 | 0 | −0.01 | 0 | 0.01 |
| −0.19 | −0.18 | −0.1 | −0.12 | −0.1 |
| 0.01 | 0.02 | 0.02 | 0.02 | 0.04 |
| −0.25 | −0.2 | −0.13 | −0.12 | −0.1 |

In the Present Invention

| | | | | |
|---|---|---|---|---|
| −0.03 | −0.04 | −0.03 | −0.01 | −0.09 |
| −0.03 | −0.03 | −0.04 | −0.01 | −0.11 |
| 0.01 | 0 | −0.01 | 0 | 0.01 |
| −0.05 | −0.06 | −0.01 | −0.03 | −0.03 |
| 0.01 | 0.02 | 0.02 | 0.02 | 0.04 |
| −0.04 | −0.04 | −0.01 | −0.04 | −0.04 |

The convergence cross in the east direction to the north direction of the red and blue pattern distribution is:

In the Prior CRT

| | | | | |
|---|---|---|---|---|
| −0.09 | −0.02 | −0.04 | −0.05 | −0.08 |
| 0.11 | 0.11 | 0.14 | 0.14 | 0.2 |
| 0.02 | 0 | −0.02 | 0.02 | 0.01 |
| 0.1 | 0.08 | 0.11 | 0.12 | 0.19 |
| 0.01 | 0 | 0.02 | 0.03 | 0 |
| 0.07 | 0.08 | 0.12 | 0.15 | 0.24 |

In the Present Invention

| | | | | |
|---|---|---|---|---|
| −0.04 | −0.02 | −0.04 | −0.05 | −0.05 |
| 0.04 | 0.05 | 0.0 | 0.05 | 0.02 |
| 0.02 | 0 | −0.02 | 0.02 | 0.01 |
| 0.02 | 0.02 | 0.01 | 0.01 | 0.05 |
| 0.01 | 0 | 0.02 | 0.03 | 0 |
| 0.01 | 0.03 | 0.03 | 0.01 | 0.04 |

From the above results, the CRT according to the present invention appears to be decreasingly affected by the earth magnetic field.

The device 2 has an inner diameter corresponding to the outer diameter of the neck 6 and thus is securely retained on the outer surface of the neck 6.

Figure 4:
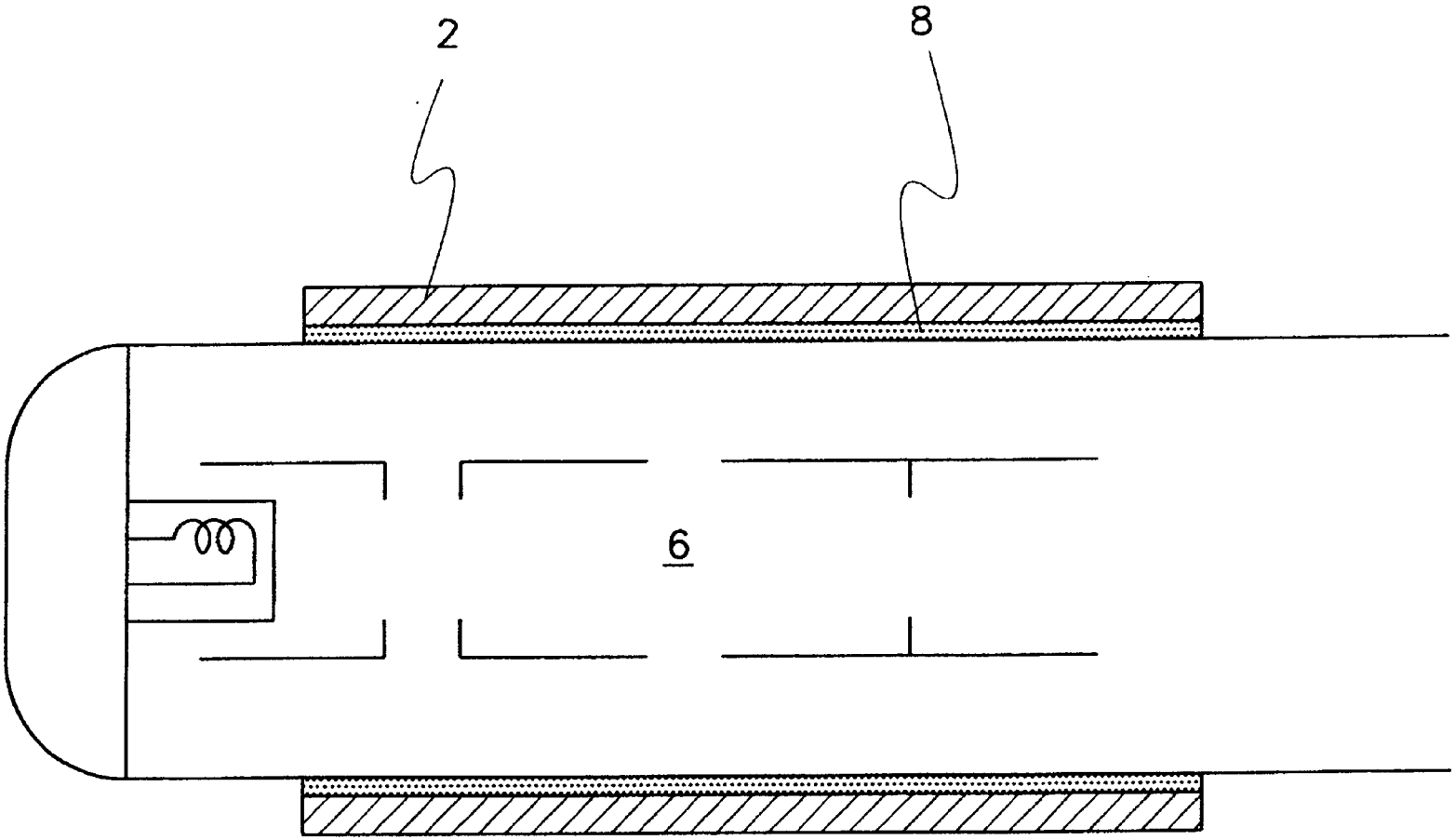
FIG. 4 is a schematic sectional view of the neck in which the device according to the invention is mounted on the neck by means of a both-sided adhesive tape.

Alternatively, as shown in FIG. 4, the device 2 may be mounted on the neck 6 by means of a both-sided adhesive tape 8 provided on the inner side of the shielding device 2.

Figure 5:
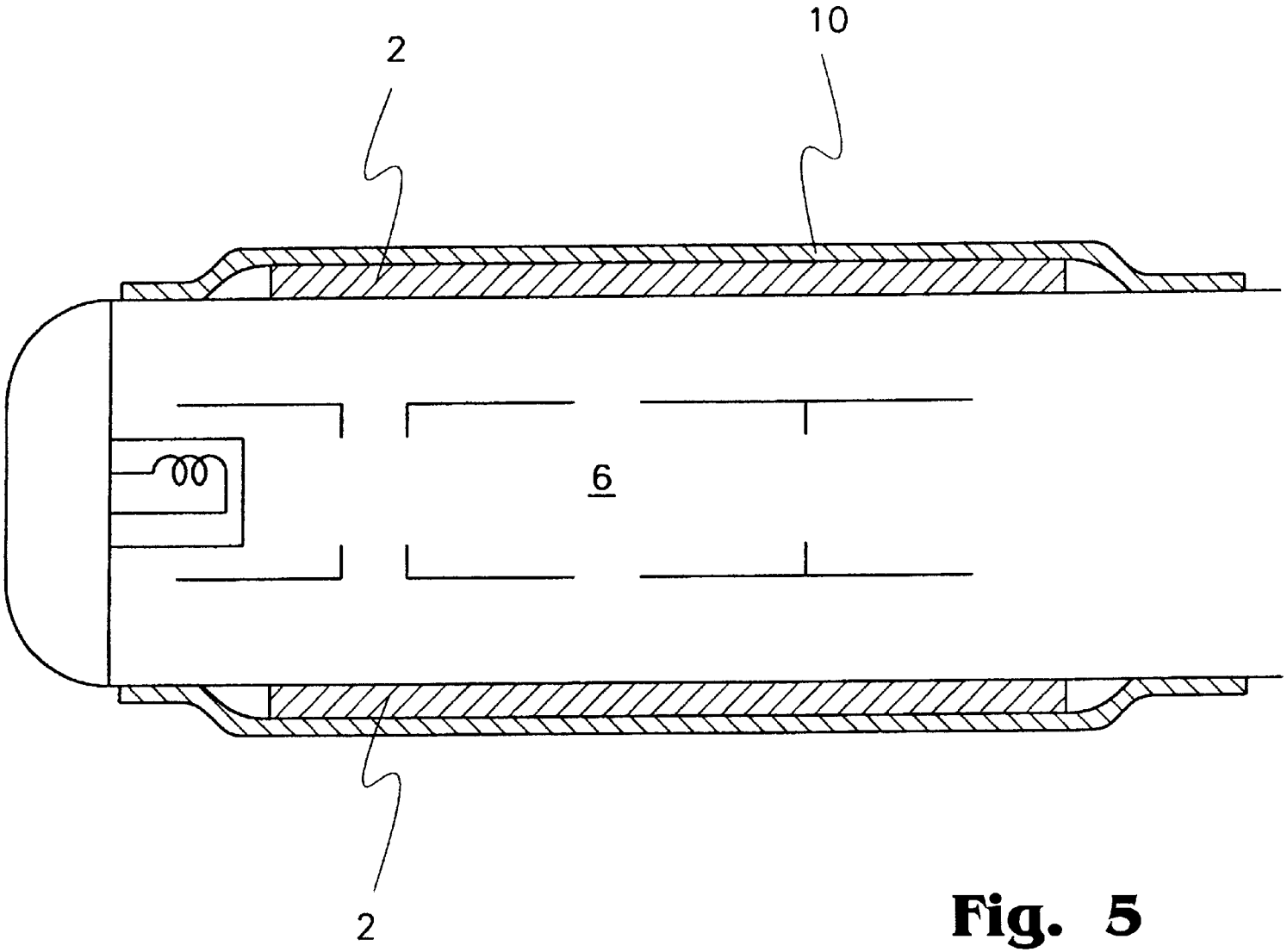
FIG. 5 is a sectional view showing the device according to the present invention mounted on the neck by means of a thermal contraction tape.

Alternatively, as shown in FIG. 5, the device 2 may be also mounted on the neck 6 by means of a thermal contraction tube 10 provided on the outer surface of the shielding device 2. The thermal contraction tube 10 is contracted by heating and retains the shielding device 2 on the periphery of the neck 6.

The device 2 may be of magnetic material having the magnetic force, for example 400 mG higher than that of the earth magnetic field, whereby the shielding effect is more improved.

Figure 6:
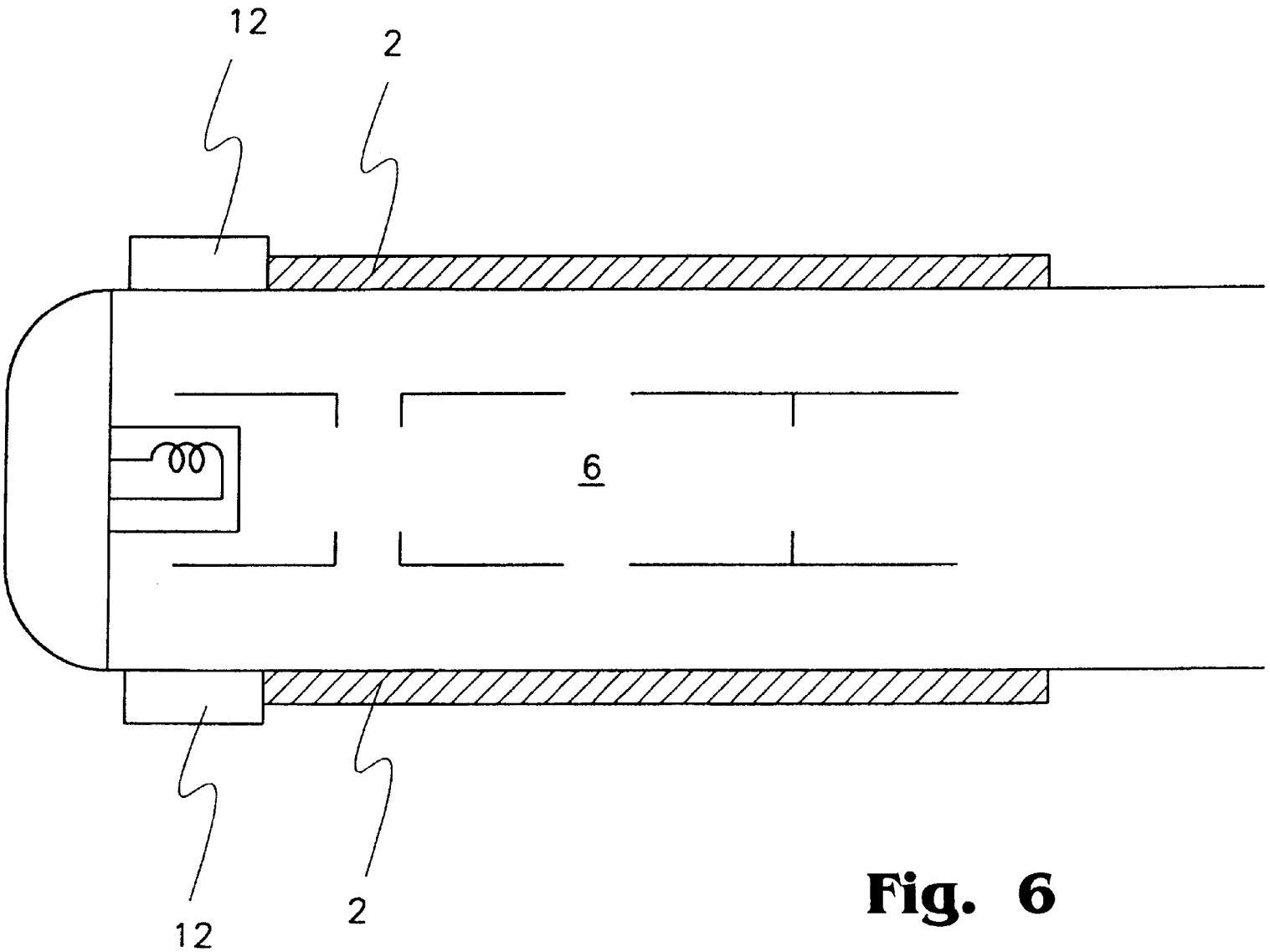
FIG. 6 is a sectional view showing the device having a permanent magnet according to the present invention.

FIG. 6 shows another embodiment of the device 2, where a permanent magnet 12 is mounted. The magnetic field is formed by the permanent magnet 12 around the device 2. And then the magnetic field counterbalances the earth magnetic field so that the affection of the earth magnetic field on the electron beams emitted from the electron gun is decreased.

According to the invention, the affection on the electron beams emitted from the electron gun by the earth magnetic field is highly decreased and the improved effect is provided, solving the prior problems that a raster position is changed and purity and convergence characteristics are deteriorated, which are caused by the affection of the earth magnetic force.

While this invention has been described in connection with what is presently considered to be the most practical and preferred embodiments, it is to be understood that the invention is not limited to the disclosed embodiments, but, on the contrary, is intended to cover various modifications and equivalent arrangements and methods included within the spirit and scope of the appended claims.

What is claimed is:

1. A cathode ray tube, comprising:

a neck; and a device for shielding the neck from an earth magnetic field, the device comprising a shielding member and a plurality of evenly spaced extension parts formed on a periphery of the shielding member, the device being made of a material comprising a Ni—Fe permalloy.

2. The cathode ray tube of claim 1, further comprised of the Ni—Fe permalloy comprises Ni of more than 50 weight percent.

3. The cathode ray tube of claim 1, further comprised of the plurality of evenly spaced extension parts being four evenly spaced extension parts.

4. A device for shielding a neck of a cathode ray tube from an earth magnetic field, comprising:

a shielding member for positioning adjacent to a neck of a cathode ray tube; and a plurality of evenly spaced extension parts formed on a periphery of the shielding member for positioning along the neck of a cathode ray tube, the device including the shielding member and the plurality of evenly spaced extension parts being made of a material comprising a Ni—Fe permalloy.

5. The device for shielding a neck of a cathode ray tube from an earth magnetic field of claim 4, further comprised of the Ni—Fe permalloy comprises Ni of more than 50 weight percent.

6. The device for shielding a neck of a cathode ray tube from an earth magnetic field of claim 4, further comprised of the shielding member including an inner diameter that is provided to be securely retained on an outer surface of the neck of a cathode ray tube.

7. The device for shielding a neck of cathode ray tube from an earth magnetic field of claim 4, further comprising:

a both-sided adhesive tape for mounting the device to a surface of the neck of a cathode ray tube.

8. The device for shielding a neck of cathode ray tube from an earth magnetic field of claim 4, further comprising:

a thermal contraction tube for retaining the device on a periphery of the neck of a cathode ray tube.

9. The device for shielding a neck of cathode ray tube from an earth magnetic field of claim 4, further comprising:

a permanent magnet provided adjacent to the device.

10. The device for shielding a neck of cathode ray tube from an earth magnetic field of claim 9, further comprised of the permanent magnet including a magnetic force in a range of from 1 mG to 10 G.

11. The device for shielding a neck of cathode ray tube from an earth magnetic field of claim 9, further comprised of the permanent magnet comprising at least one material selected from the group consisting of ferrite and rubber.

12. The device for shielding a neck of a cathode ray tube from an earth magnetic field of claim 4, further comprised of the plurality of evenly spaced extension parts being four evenly spaced extension parts.

13. A device for shielding a neck of a cathode ray tube from an earth magnetic field, comprising:

a shielding member for positioning adjacent to a neck of a cathode ray tube;

a plurality of evenly spaced extension parts formed on a periphery of the shielding member for positioning along the neck of a cathode ray tube, the device including the shielding member and the plurality of evenly spaced extension parts being made of a material of a high magnetic permeability and low coercive force; and a both-sided adhesive tape for mounting the device to a surface of the neck of a cathode ray tube.

14. The device for shielding a neck of a cathode ray tube from an earth magnetic field of claim 13, further comprised of the plurality of evenly spaced extension parts being four evenly spaced extension parts.

15. A device of shielding a neck of a cathode ray tube from an earth magnetic field, comprising:

a shielding member for positioning adjacent to a neck of a cathode ray tube;

a plurality of evenly spaced extension parts formed on a periphery of the shielding member for positioning along the neck of a cathode ray tube, the device including the shielding member and the plurality of evenly spaced extension parts being made of a material of a high magnetic permeability and low coercive force; and a thermal contraction tube for retaining the device on a periphery of the neck of a cathode ray tube.

16. The device for shielding a neck of a cathode ray tube from an earth magnetic field of claim 15, further comprised of the plurality of evenly spaced extension parts being four evenly spaced extension parts.

17. A device for shielding a neck of a cathode ray tube from an earth magnetic field, comprising:

a shielding member for positioning adjacent to a neck of a cathode ray tube;

a plurality of evenly spaced extension parts formed on a periphery of the shielding member for positioning along the neck of a cathode ray tube, the device including the shielding member and the plurality of evenly spaced extension parts being made of a material of a high magnetic permeability and low coercive force; and a permanent magnet provided adjacent to the device.

18. The device for shielding a neck of a cathode ray tube from an earth magnetic field of claim 17, further comprised of the plurality of evenly spaced extension parts being four evenly spaced extension parts.

19. The device for shielding a neck of a cathode ray tube from an earth magnetic field of claim 17, further comprised of the permanent magnet including a magnetic force in a range of from 1 mG to 10 G.

20. The device for shielding a neck of a cathode ray tube from an earth magnetic field of claim 17, further comprised of the permanent magnet comprising at least one material selected from the group consisting of ferrite and rubber.

* * * * *